US012083590B2

(12) United States Patent
Masleid et al.

(10) Patent No.: US 12,083,590 B2
(45) Date of Patent: Sep. 10, 2024

(54) METHOD FOR MAINTAINING THE OPTIMAL AMOUNT OF INERT GAS BEING INJECTED INTO CAST STEEL

(71) Applicant: ArcelorMittal, Luxembourg (LU)

(72) Inventors: Michael Masleid, Dyer, IN (US); Bruce Ross Forman, Valparaiso, IN (US); Bernard O. Chukwulebe, Lansing, IL (US)

(73) Assignee: ArcelorMittal, Luxembourg (LU)

( * ) Notice: Subject to any disclaimer, the term of this patent is extended or adjusted under 35 U.S.C. 154(b) by 141 days.

(21) Appl. No.: 17/919,824

(22) PCT Filed: Apr. 20, 2020

(86) PCT No.: PCT/IB2020/053705
§ 371 (c)(1),
(2) Date: Oct. 19, 2022

(87) PCT Pub. No.: WO2021/214509
PCT Pub. Date: Oct. 28, 2021

(65) Prior Publication Data

US 2023/0201919 A1 Jun. 29, 2023

(51) Int. Cl.
*B22D 41/42* (2006.01)
*B22D 11/117* (2006.01)
*B22D 41/58* (2006.01)

(52) U.S. Cl.
CPC ..... *B22D 41/58* (2013.01); *B22D 11/117* (2013.01); *B22D 41/42* (2013.01)

(58) Field of Classification Search
CPC ..... B22D 11/10; B22D 11/117; B22D 41/42; B22D 41/58
See application file for complete search history.

(56) References Cited

U.S. PATENT DOCUMENTS 6,660,220 B2 * 12/2003 Forman ..... C21C 5/4653 222/603

FOREIGN PATENT DOCUMENTS

JP 62197257 A * 8/1987

* cited by examiner

*Primary Examiner* — Kevin E Yoon
(74) *Attorney, Agent, or Firm* — Davidson Kappel LLC

(57) ABSTRACT

A method for maintaining the optimal argon injection flow rate which will result in production of steel slab of a chosen alloy having optimal cleanliness. The steel is cast using an argon injected slide gate. The selected steel has a known optimal argon injection flow rate Qb* for casting steel of optimal cleanliness. The method involves calculating the present steel pressure and determining the present injection flow rate conductance Gb' of the argon injected slide gate during either of 1) a steel pressure change event; or 2) an argon flow change event. The measurements are used to calculate present argon pressure required to insure the required injection flow rate of argon into the steel for optimal cleanliness of the cast steel.

5 Claims, 10 Drawing Sheets

METHOD FOR MAINTAINING THE OPTIMAL AMOUNT OF INERT GAS BEING INJECTED INTO CAST STEEL

FIELD OF THE INVENTION

The present invention relates to continuous steel casting and more specifically to inert gas injected slide gates used in continuous steel casting. Most specifically the invention relates to a method to maintain the optimal volume flow rate of argon injected into the steel through the slide gate.

BACKGROUND

In steelmaking operations, a slide gate is used to control the flow of liquid steel through a nozzle arrangement that drains the molten liquid steel from a metallurgical vessel. It is well known in the art that when inert gas is injected into the discharge passageway of the slide gate, the injected inert gas will reduce plugging or build-up that clogs the passageway. Continuing advancements in the art have led to the use of porous, gas permeable nozzles and slide gate plates that are able to deliver a continuous or intermittent inert gas flow to the discharge passageway where the delivered gas provides a gas barrier between the passageway surface and the liquid metal being drained. Such porous nozzles and slide gate plates are disclosed in U.S. Pat. No. 5,431,374 ('374) incorporated herein in its entirety by reference.

SUMMARY OF THE INVENTION

Referring to columns 1 and 2, the '374 patent discloses, although it is not certain, it is believed the inert gas flows through the porous nozzle walls, and advantageously forms a fluid film over the surface of the bore within the nozzle that prevents the liquid metal from making direct contact with the inner surface forming the bore. By insulating the bore surface from the liquid metal, the fluid film of gas prevents the small amounts of alumina that are present in such steel from sticking to and accumulating on the surface of the nozzle bore. The '374 reference also teaches that such alumina plugging will occur within the bore of a slide gate if an inert gas barrier is not provided. Therefore, as clearly taught in the art, for example, U.S. Pat. Nos. 4,756,452, 5,137,189, 5,284,278, and 5,431,374, inert gas barriers are used throughout the steelmaking industry to prevent alumina plugging within the discharge passageway that drains liquid steel from a tundish into the caster mold portion of a continuous caster.

Additionally, the '374 patent also discloses that in order to provide a proper inert gas barrier, the pressure of the inert gas must be maintained at a level sufficient to overcome the considerable back-pressure that the draining liquid steel product applies against the surface of the bore, and ideally, the gas pressure should be just enough to form the desired film or barrier. It is well accepted that injecting inert gas into a slide gate discharge passageway does reduce the plugging phenomenon but metering the actual gas flow to the discharge-opening has long been a problem. Leaks in the gas delivery system are a repeating and continuous problem, and the measured amount of incoming gas flow is often different from the actual gas flow delivered to the liquid metal draining through the slide gate. Such gas delivery system leaks can occur in any one of the numerous pipefitting connections along the gas feed line extending between the inert gas supply and the slide gate mechanism. Additionally, some leaks are dynamic in that they develop in the slide gate plates during casting operations as taught in U.S. Pat. No. 4,555,094. Historical information at continuous casting operations shows that in many instances, no inert gas is delivered to the slide gate discharge passageway when the control gage readings show that the inert gas flow through the gas feed line is normal. The currently employed constant pressure or constant flow-based control methods that are used to deliver inert gas to a slide gate mechanism cannot compensate for dynamic leaks, flow resistance changes, or unknown pressure drops, and therefore, they are ineffective for maintaining a target threshold gas flow within the discharge passageway. Consequently, the state-of-the-art inert gas delivery systems often fail to shield the bore surface from the liquid metal as taught in U.S. Pat. No. 5,431,374.

In U.S. Pat. No. 6,660,220 ('220) the present inventor provided for a dynamic control system capable of delivering an inert gas at a target threshold gas flow rate to the discharge passageway in a slide gate draining a liquid metal product. The system was also capable of measuring inert gas flow resistance to determine an amount of plugging that occurs within the discharge opening passageway that drains liquid metal from a metallurgical vessel.

In addition, the '220 patent provided a mathematical model that provides on-line evaluation and dynamic control of the inert gas delivery system so that a consistent inert gas flow is maintained to prevent or reduce plugging within the discharge opening passageway that drains liquid metal from a metallurgical vessel. The dynamic control system maintains the inert gas at a constant target threshold flow rate sufficient to prevent or reduce plugging within the discharge opening, and the dynamic control system includes a gas feed line extending between an inert gas supply and the slide gate discharge passageway, a gas flow regulator, a pressure gauge; and a gas feed flow control system that detects an amount of incoming inert gas flow lost through leaks in the system and adjusts the gas flow regulator in response to the detected amount of incoming gas flow loss so that the adjusted incoming gas flow continues to deliver the target inert gas flow rate to the discharge passageway.

However, the '220 system/process only deals with inert gas losses up to the entry of the slide gate valve and does nothing to determine the portion of the inert gas that is actually injected to the steel versus that which is lost due to leaks in the slide gate itself. Improper flow rate of inert gas into the steel can cause issues such as: the re-oxidation of liquid steel (too little argon); blister type defects in slabs (excessive argon); plugging of the flow control system limiting casting time; and excessive plugging and wash-out during casting, that can cause entrainment of non-metallic inclusions. Furthermore, as casting time increases, the ratio of the inert gas injected into the steel versus that lost due to leaks changes. The slide gate warps, and the leaks increase until virtually no inert gas is being injected into the steel. For several applications, it would be useful to be able to determine how much gas is injected into the steel versus how much is leaked from the system.

One such application is to determine the optimal argon flow rate into the steel required for each steel composition to provide optimal steel cleanliness. The present invention provides a process to determine these optimal flow rates.

One aspect of the invention is a method for determining the optimal argon injection flow rate for a chosen alloy composition to produce optimal steel cleanliness in cast steel.

The method includes the step of providing an argon injected slide gate controlling the flow of liquid steel through a nozzle. A desired alloy for casting into slabs is chosen, having a known optimal argon injection flow rate Qb*. The present injection flow rate conductance Gb' of said argon injected slide gate is determined using either the Steel Pressure Change Event Method or the Argon Flow Rate Change Event Method. The present steel pressure Ps' is calculated by multiplying the present height of the steel above the argon injection point by the density of the selected steel composition times the acceleration due to gravity. The required present argon pressure Pa' to provide the optimal argon injection flow rate Qb* is then calculated using the equation Pa'=Qb*/Gb'+Ps' and the present argon pressure Pa' is adjusted to the calculated value. The selected steel composition is then cast while injecting argon into said steel at the optimal argon injection flow rate Qb*. The casting continues while Gb' and Ps', and consequently Pa', are recalculated on regular basis until all of the selected steel has been cast.

DETAILED DESCRIPTION OF THE INVENTION

Figure 1:
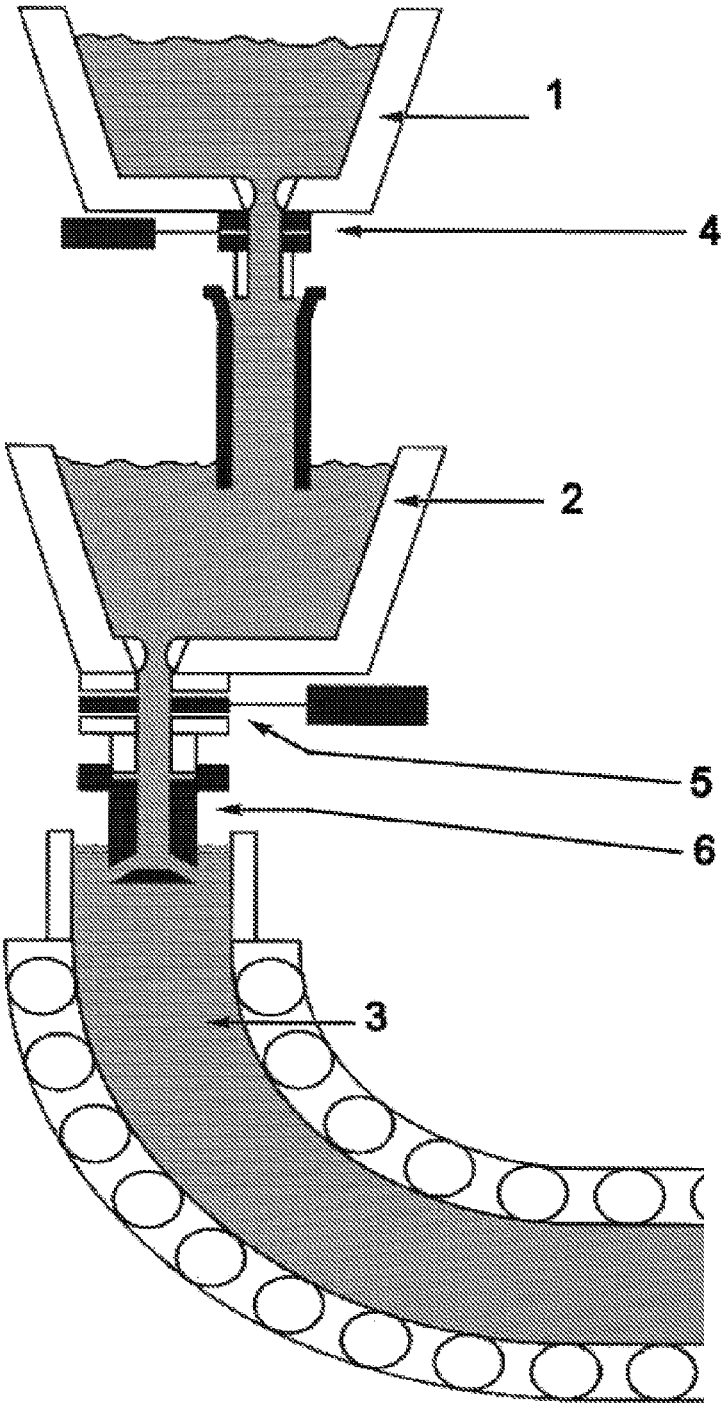
FIG. 1 depicts a schematic view of a continuous steel casting system.
Figure 2:
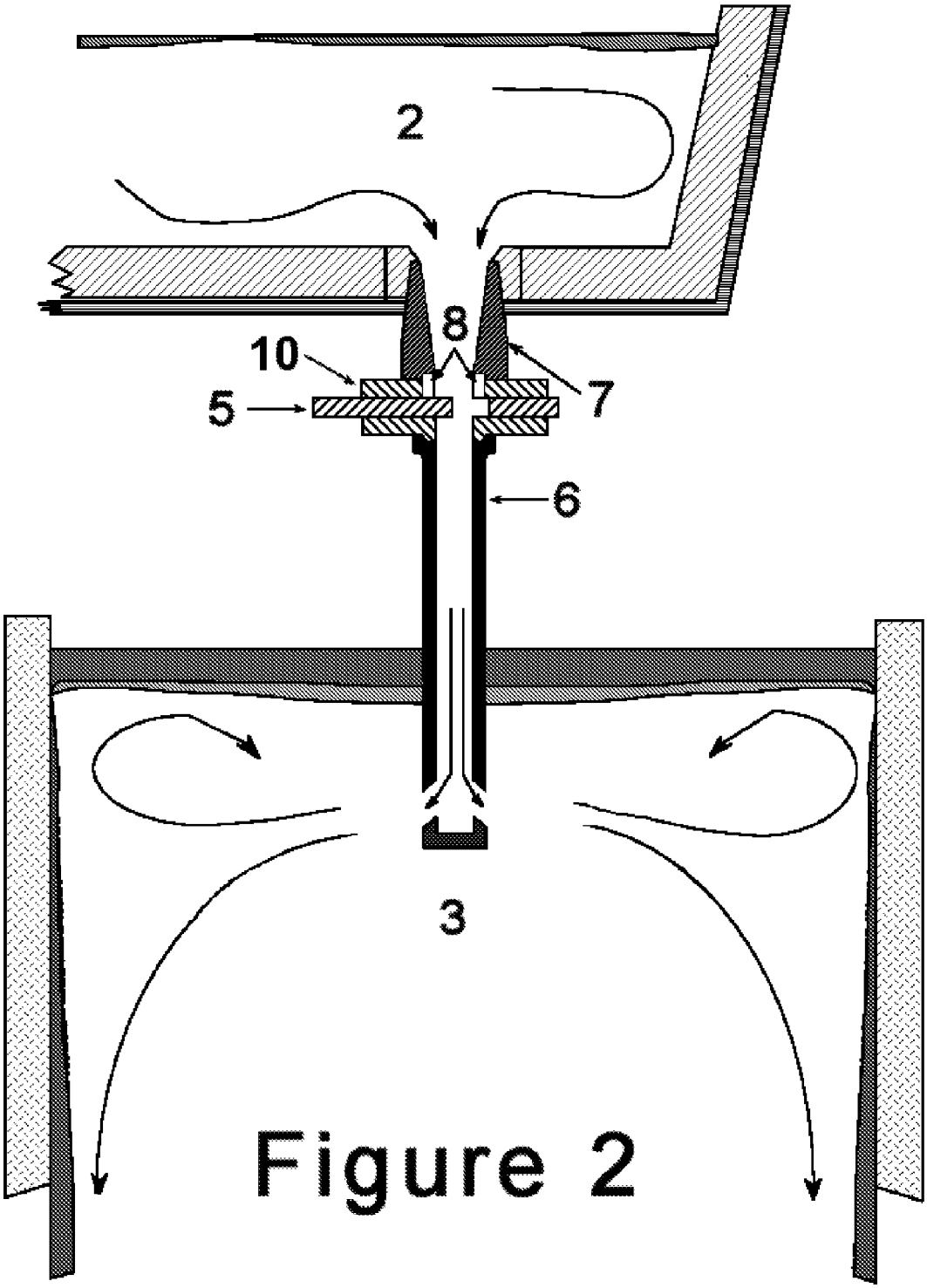
FIG. 2 depicts a schematic view of the tundish and slide gate of a continuous steel casting system.

FIG. 1 depicts a schematic view of a continuous steel casting system which streams molten steel from a ladle 1 through a ladle slide gate valve 4 to a tundish 2, and through a tundish slide gate valve 5 and a submerged entry nozzle (SEN) 6 into a mold 3. FIG. 2 depicts a schematic view of the tundish 2 streaming steel through the upper nozzle 7, through the slide gate 5, through the SEN 6 and into the mold 3. In steel casting, Argon injection is used to reduce the rate of oxygen diffusion into the molten steel. It is also injected into molten steel to provide stirring and to improve steel cleanliness by removing or controlling the amount, size, and distribution of inclusions incorporated into the steel being cast. The argon is supplied to the steel through a porous material. In FIG. 2 the porous material is in the shape of a ring 8 in the top plate 10 of the slide gate 5.

Figure 3:
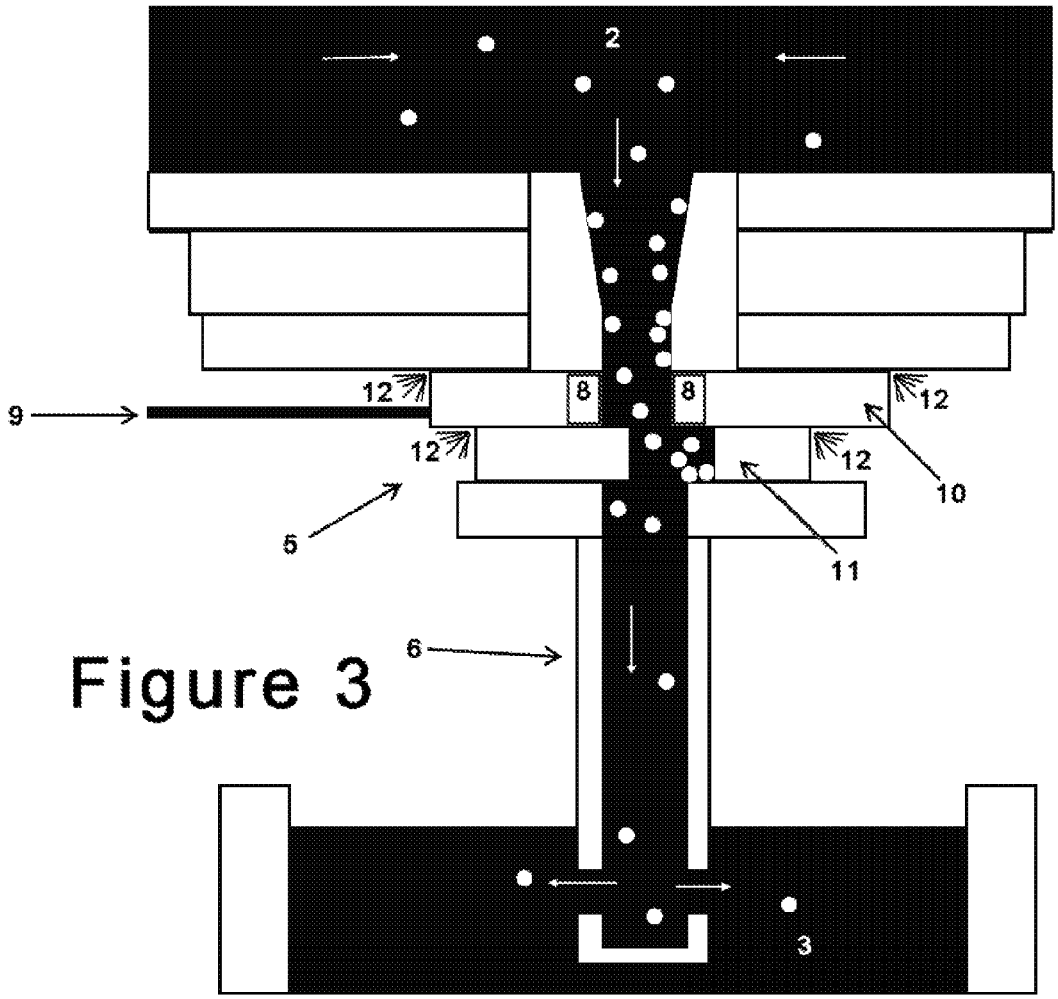
FIG. 3 depicts a schematic of the section of the steel casting apparatus focusing on the slide gate.

FIG. 3 depicts a schematic of the section of the steel casting apparatus focusing on the slide gate 5. Argon is injected into the slide gate 5 through an injection system as described in the '220 patent. The argon is injected into the porous member 8 and is injected into the steel. Some of the argon percolates through the porous ceramic 8 and is injected into the steel flowing into the mold 3. The rest of the argon may find another path into the steel and bubble out into the tundish 2. Some of the argon leaks back out through gaps and cracks in the assembly as indicated by leaks 12. This helps reduce the amount of oxygen leaking in.

Direct measurement or observation of argon injection is difficult. Using the present invention, it is possible to determine the fractions of argon leaking to atmosphere, being injected into the steel flow, and bubbling into the tundish by combining information obtained during the casting process.

Measurements used by the present inventive method include the time-based values of tundish weight, cast speed, mold level and mold width that are used to calculate steel head pressure and steel flow pressure. The argon panel provides argon pressure and argon flow. The estimator is based on three independent combinations of pressures and flow.

In one aspect of the present inventive method, constants include the height of the steel level above the argon injection point, the density of the steel at the operating temperature and the acceleration due to gravity.

The present inventive method includes a step to reconstruct measurements as simultaneous values taken at equal time intervals. In this implementation sparse measurements are supplied at the nearest second of a measurement. A symmetric Gaussian window is used to sum available values near a given second, and another symmetric Gaussian window is used to sum existence (1 or 0) of the available value near the given second. The average, the first sum divided by the second sum, provides an estimate of the value as though the measurement was taken at the given second. In another implementation, where measurements are supplied with their measurement time stamp, spline interpolation methods can be used.

Figure 4:
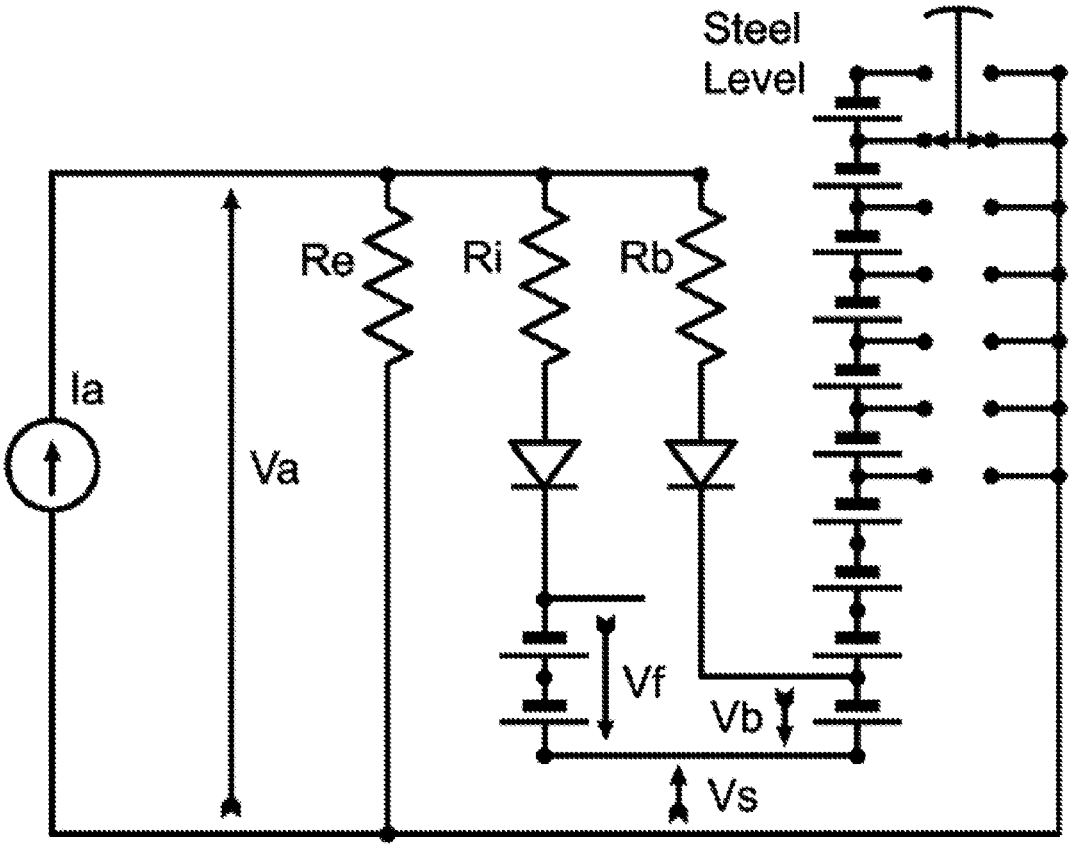
FIG. 4 depicts an electrical circuit model which is analogous to the slide gate of the casting system.

The present invention uses an analogy between linear flow through porous media (Darcy's Law) and an equivalent linear electrical circuit. The flow path can be represented in three components. Some argon escapes to the atmosphere. Some is injected into the steel flow. Some bubbles into the steel column. The analogous electrical model is shown in FIG. 4. In that model: Vs represents ferrostatic pressure at the bore hole; Vf represents pressure drop from steel flow through the bore hole; Vb represents the pressure difference between the bore hole and an upper surface of the porous ceramic.

Figure 5:
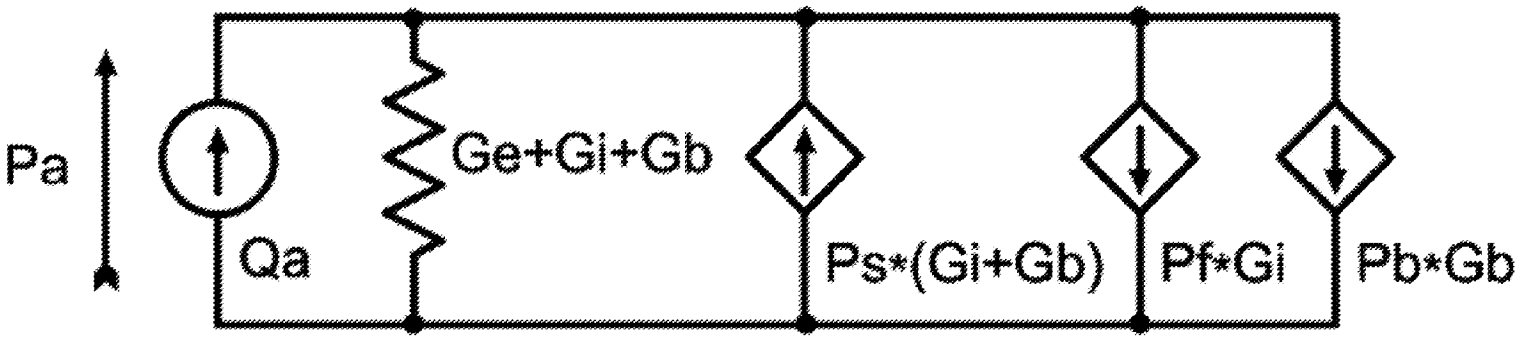
FIG. 5 is a simplified circuit solving the circuit FIG. 4.

In the electrical analog, la corresponds to argon flow, Va corresponds to argon gauge pressure, Vs corresponds to the ferrostatic pressure in the bore hole, and Vb refers to the ferrostatic pressure at the top of the insert. The resistance, Re, is the resistance to flow out of the bottom of the insert including the resistance to flow through the space between the top plate and the throttle plate (i.e. resistance to flow to the atmosphere). The resistance, Ri, is the resistance to flow through the insert into the bore hole. The resistance, Rb, is the resistance to flow through the insert to the upper surface and up into the funnel. Ri and Rb are both resistances to flow into the steel. The steel flow through the bore hole will cause a pressure drop represented by Vf. Argon flow into the injection point may be purged to the atmosphere or may be injected into the steel against the backpressure produced by the height of the steel above the injection point. The flow of steel past the injection point causes a pressure drop, so the actual pressure at the injection point is slightly reduced. Argon bubbling out above the injection point must work against the back pressure due to the height of the steel at the point of bubbling. Argon can flow into the steel but cannot flow backwards (this is represented by diodes). Solving the circuit in FIG. 4 yields the circuit in FIG. 5.

Voltage is replaced by pressure. Resistance is replaced by its reciprocal, conductance. Argon flow is in cubic centimeters per second ($cm^3/s$), pressure is in megapascals (MPa), and conductance is in ($cm^3/s/MPa$). The network solution for argon pressure is:

$$\mathrm{Pa} = \frac{Qa}{Ge+Gi+Gb} + \frac{Ps(Gi+Gb)}{Ge+Gi+Gb} - \frac{PjGi}{Ge+Gi+Gb} \tag{1}$$

Here, Pa is the argon pressure as measured. Qa is the argon flow controlled to a set point. Ps is the calculated ferrostatic head pressure where argon is injected into the steel flow. Pf is the calculated pressure reduction due to steel flow past where argon is injected into that steel flow. Pb is the difference between ferrostatic pressure at the high flow injection point and the ferrostatic pressure at the bubbling site (next to the bore hole for the top plate geometry).

a. Argon cannot flow out of the steel. The backflow conditions can be implemented as:

$$Gb=0 \text{ when } (Ps-Pb)\geq Pa$$

$$Gi=0 \text{ when } (Ps-Pf)\geq Pa \tag{2}$$

The height of steel in the tundish (in centimeters cm) can be calculated from the tundish geometry and the density and weight of the steel in the tundish. The distance from the bottom of the tundish to the injection point can be measured. The pressure at the injection point (Ps) is the product of steel density (in $g/cm^3$) times the total height of steel above the injection point times the acceleration due to gravity.

The position of the bubbling leak relative to the injection point is not known. As an initial assumption the bubbling leak is above the injection point and remains constant. The pressure (loss) due to bubbling distance (Pb) is the product of steel density (in $g/cm^3$) times the distance above the injection point times the acceleration due to gravity.

The pressure (loss) due to laminar steel flow (Pf) can be determined using the flow volume (cast speed times mold thickness times mold width). Divide this by the cross-sectional area at the injection point to get the flow velocity. Bernoulli's equation gives the pressure due to steel flow as one half the velocity squared times the steel density.

The components of the argon flow are determined by observing measurements taken during the casting process. Events, such as ladle changes, steel flow changes, and argon flow changes are detected. Each type of event is processed to provide solutions to parts of the analogous circuit.

A ladle change event stops flow of steel into the tundish but does not stop the continuous casting process. The tundish weight changes as the tundish empties. The level of steel in the tundish drops. Therefore, the ferrostatic head pressure at the bottom of the tundish also drops.

A speed change and mold size change can result in a change in flow rate out of the tundish. The change in flow through the injection point changes the ferrostatic pressure loss due to the flow velocity.

A change in argon flow reduces the pressure drop caused by argon flow into the steel or through purge paths into the atmosphere.

The steel flow event (a change in the product of cast speed times mold size) will cause the plot of Pa against Pf to have a slope equal to the derivative of:

$$\frac{\delta \mathrm{Pa}}{\delta Pf} = \frac{-Gi}{(Ge+Gi+Gb)}$$

The Pa intercept (at Pf=0) will be $$\lim_{Pf\to 0} \mathrm{Pa}(Ge+Gi+Gb) = (Qa+PsGi+PbGb)$$

It follows that:

$$\frac{\delta \mathrm{Pa}}{\delta Pf}\frac{1}{\lim_{Pf\to 0}\mathrm{Pa}} = \frac{-Gi}{(Ge+Gi+Gb)}\frac{(Ge+Gi+Gb)}{(Qa+Ps(Gi+Gb)-PbGb)} = \frac{-Gi}{(Qa+Ps(Gi+Gb)-PbGb)} \tag{3}$$

The steel pressure change event will cause the plot of Pa against Ps, while weight is changing, to have a slope equal to the derivative of:

The Pa intercept (at Ps=0) will be at:

$$\lim_{Ps\to 0} \mathrm{Pa}(Ge+Gi+Gb) = (Qa-PfGi-PbGb)$$

It follows that:

$$\frac{\delta \mathrm{Pa}}{\delta Ps}\frac{1}{\lim_{Ps\to 0}\mathrm{Pa}} = \frac{Gi+Gb}{(Ge+Gi+Gb)}\frac{(Ge+Gi+Gb)}{(Qa-PfGi-PbGb)} = \frac{Gi+Gb}{(Qa-PfGi-PbGb)} \tag{4}$$

The argon flow change event will cause a plot of Pa against Qa, while weight is not changing, to have a slope equal to the derivative of:

$$\frac{\delta \mathrm{Pa}}{\delta Qa} = \frac{1}{(Ge+Gi+Gb)}$$

The Pa intercept (at Qa=0) will be at:

$$\lim_{Qa\to 0} \mathrm{Pa}(Ge+Gi+Gb) = (Ps(Gi+Gb)-PfGi-PbGb)$$

It follows that:

$$\frac{\delta \mathrm{Pa}}{\delta Qa}\frac{1}{\lim_{Qa\to 0}\mathrm{Pa}} = \frac{1}{(Ge+Gi+Gb)}\frac{(Ge+Gi+Gb)}{(Ps(Gi+Gb)-PfGi-PbGb)} = \frac{1}{(Ps(Gi+Gb)-PfGi-PbGb)} \tag{5}$$

These equations apply for small changes in argon pressure, where argon pressure remains greater the ferrostatic head pressure. Large changes in argon pressure require a piece wise linear solution, since argon flow into steel is not reversible.

EXAMPLES

Steel Pressure Change Event

Figure 6:
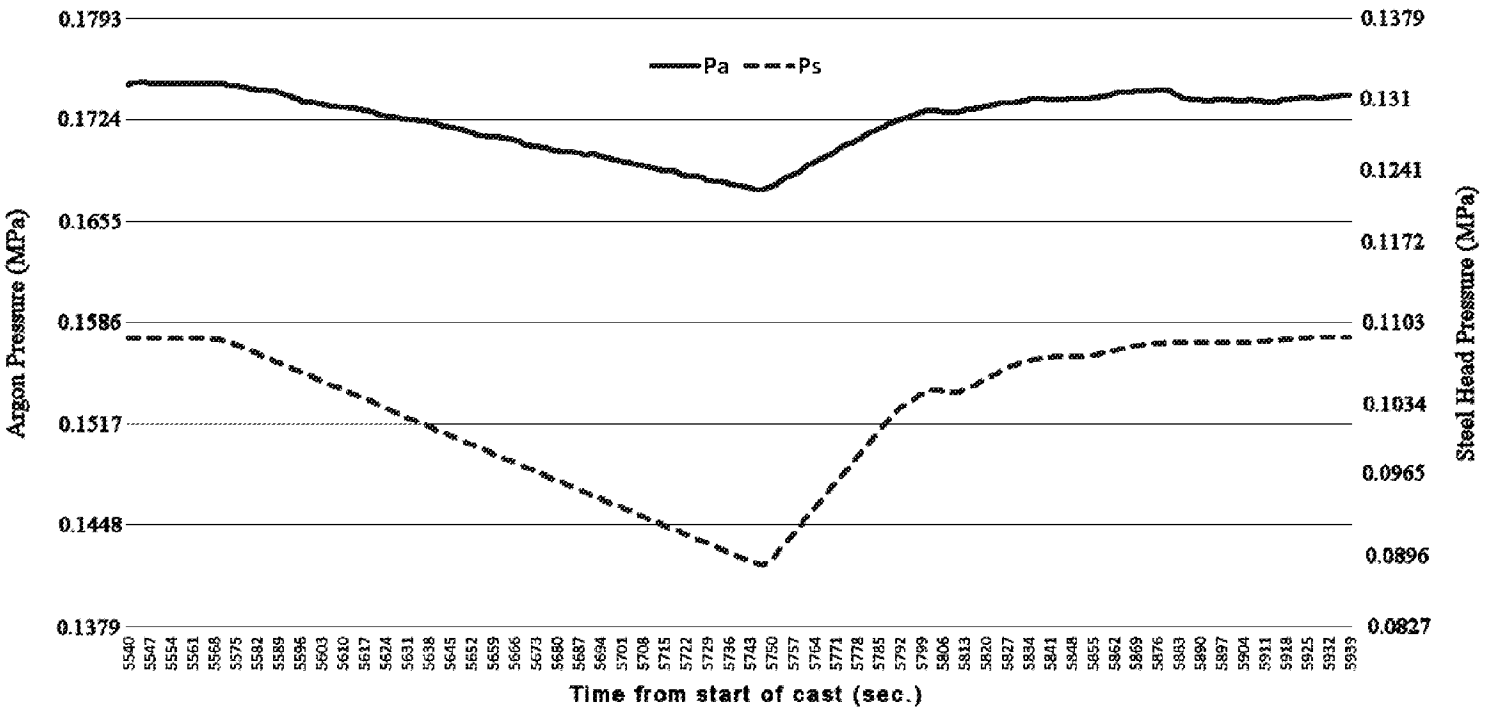
FIG. 6 plots the argon pressure (Pa) and steel head pressure (Ps) vs the casting time during a steel pressure change event.

FIG. 6 plots the argon pressure (Pa) and steel head pressure (Ps) vs the casting time during a ladle change event.

Figure 7:
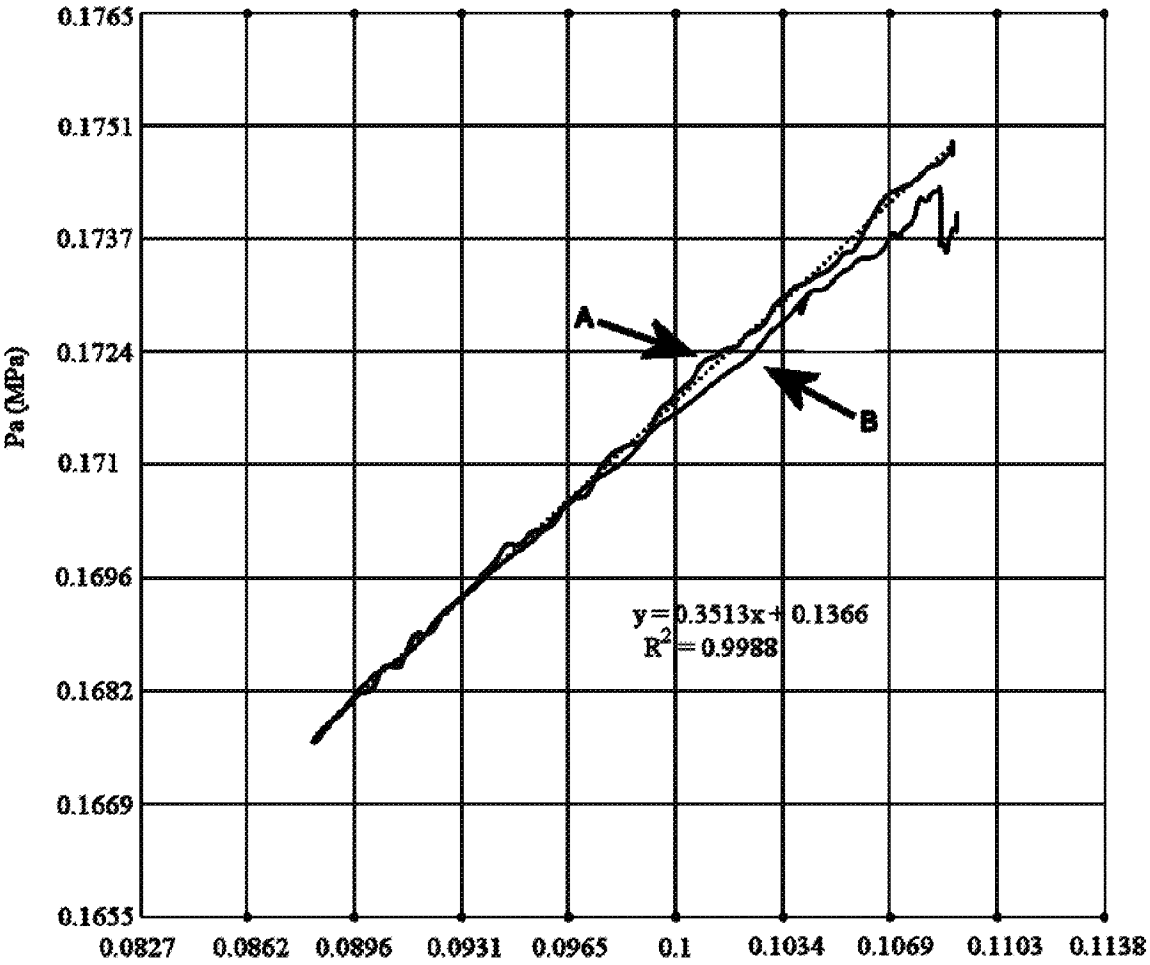
FIG. 7 is a plot of Ps (x-axis) vs. Pa (y-axis) a steel pressure change event caused by a ladle change.

The ladle change event produces a distinct dip in argon pressure (as steel pressure drops) when argon pressure is greater than steel pressure. Argon pressure is measured at the argon panel. Argon is supplied to a top plate. Steel flow pressure is not used for this calculation due to turbulent flow at the bore hole. During the event, the mean argon flow is 200.4 $cm^3/s$. FIG. 7 is a plot of Ps (x-axis) vs. Pa (y-axis) during ladle change as the level of steel in the tundish is falling A and then subsequently refilling B. The falling curve A follows the equation y=0.3513x+0.1366 MPa. Using this falling edge trend line with equation (4) from above, and wherein:

$$\delta Pa/\delta Ps = 0.3513 \text{ and}$$

$$1/\lim_{Ps\to 0} = 0.1136$$

$$\frac{Gi+Gb}{(Qa-PfGi-PbGb)} = 0.3513/0.1366 \text{ MPa} = 2.5717/\text{MPa}$$

Setting Gi=0 for the top plate and solving for Gb with Pb=0, then using the argon pressure and steel head pressure after the event to calculate argon injected as bubbles from the top plate. Solving for Gb using the mean value for argon flow:

$$\frac{Gb}{2.572}\ [\text{MPa}] = 200.4[\text{cm}^3/\text{s}]$$

$$0.389\ Gb[\text{MPa}] = 200.4\ [\text{cm}^3/\text{s}]$$

$$Gb = 515.4\ [\text{cm}^3/\text{s/MPa}]$$

Now we can calculate argon injection (as bubbles into the steel column) after the event using argon and steel pressure just after the event where Pa=0.1741 MPa and Ps=0.109 MPa.

$$Qi(Pa-Ps)Gi=(0.1741-0.109)515.4=33.5\ [\text{cm}^3/\text{s}]$$

The amount of argon escaping can be found from the derivative. Solve for Ge:

$$\frac{\delta Pa}{\delta Ps} = \frac{Gi+Gb}{Ge+Gi+Gb}$$

$$0.3513 = \frac{0+515.4}{Ge+0+515.4}$$

$$Ge+515.4 = 515.4/0.3513$$

$$Ge = (515.4/0.3513) - 515.4$$

$$Ge = 951.7\ [\text{cm}^3/\text{s/MPa}]$$

Calculate the argon escaping based on the argon pressure after the event:

$$Qe=0.1741*951.7=165.7\ [\text{cm}^3/\text{s}]$$

The calculated sum of argon injected (as bubbles) and argon escaping after the event is 199.2 $cm^3/s$ which is slightly smaller than the amount, 200.4 $cm^3/s$, of argon supplied. The event was chosen at a time when the caster was stable with respect to argon escape.

Argon Flow Change Event

Figure 8:
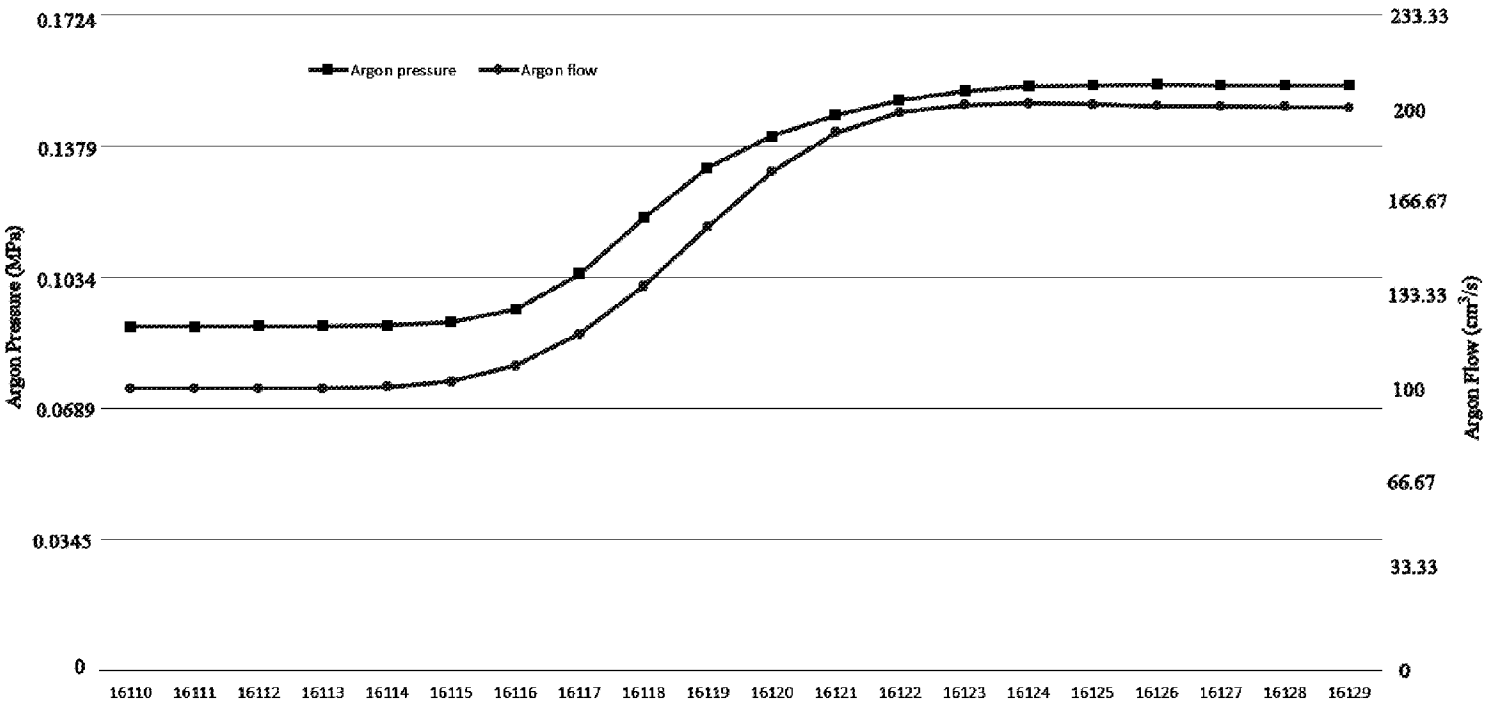
FIG. 8 is a plot of argon pressure (Pa) and argon flow (Qa) vs time during an argon flow change event.

The argon flow change event produces a very large drop in argon pressure, but the argon pressure drops below steel pressure, and will require a piecewise linear solution. FIG. 8 is a plot of argon pressure Pa and argon flow Qa vs time as an SEN is changed. During the event, the steel head pressure is 0.1091 MPa.

Figure 9:
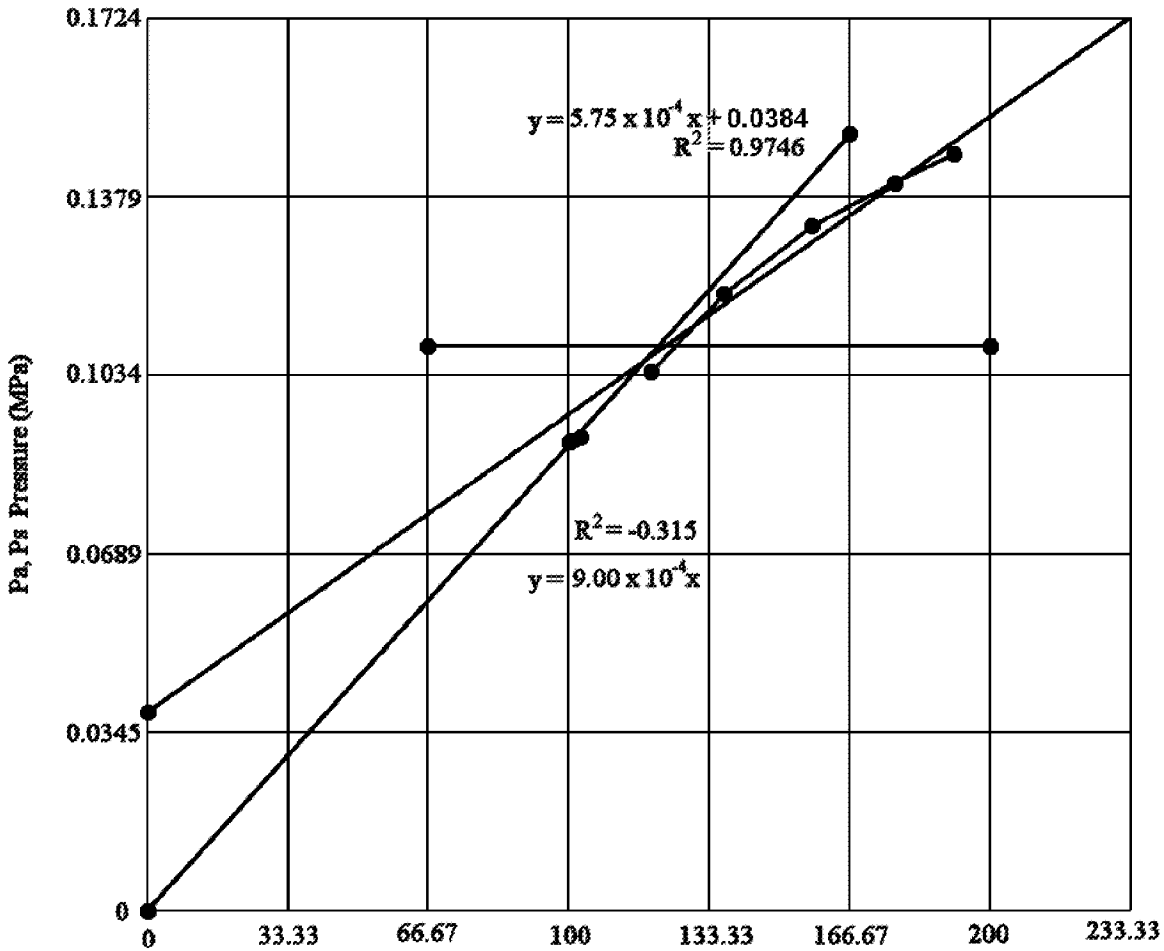
FIG. 9 is a plot of Qa vs Pa during the Argon flow event.

FIG. 9 is a plot of Qa (x-axis) vs. Pa (y-axis) during the event Argon pressure rises as argon flow overcomes leak (purge) resistance. Once argon pressure exceeds steel pressure, argon pressure rises more slowly because resistance has a parallel path. Argon flow begins to bubble into the steel. The two different regimes can be seen in FIG. 9. One flow regime has a fitted line having a slope of $9.0\times10^{-4}$ and an intercept of 0. The other regime has a fitted line having a slope $5.75\times10^{-4}$ and an intercept of 0.0345. For the first segment Gi=0 and Gb=0. Although we have solved for this segment, it should be noted that this segment will give no useful information on argon injection into the steel because all argon is escaping (none is being injected, i.e. Pa<Ps):

$$\frac{\delta Pa}{\delta Qa} = \frac{1}{(Ge+Gi+Gb)} = \frac{1}{(Ge+0+0)} = 9.0\times10^{-4}\ [\text{cm}^3/\text{s/MPa}]$$

$$Ge = 1111.1\ [\text{MPa/cm}^3/\text{s}]$$

Solving for the second segment where Gb #0 we can use equation (5):

$$\frac{1}{(Ps(Gi+Gb)-PfGi-PbGb)} = \frac{1}{(Ps(0+Gb)-Pf\times0-0\times Gb)} = \frac{1}{0.1091\ Gb} = \frac{5.75\times10^{-4}}{0.0384}\ [\text{s/cm}^3]$$

$$66.78\ [\text{cm}^3/\text{s}] = 0.1091\ Gb[\text{MPa}]$$

$$Gb = 612.1\ [\text{cm}^3/\text{s/MPa}]$$

Now solve for Ge:

$$\frac{\delta Pa}{\delta Qa} = \frac{1}{(Ge+Gi+Gb)} = \frac{1}{(Ge+0+612.1)}$$

$$5.75\times10^{-4} = \frac{1}{Ge+612.1}$$

$$Ge = 1127\ [\text{MPa/cm}^3/\text{s}]$$

Argon escape during the event is changing continuously as Pa×Ge. Now we calculate argon injection (as bubbles into the steel column) and argon escaping after the flow event using argon and steel pressure just after the event where Pa=0.1537 MPa, Ps=0.1091 MPa, then we compare that to Qa=200.4 [$cm^3/s$]:

$$Qb=(0.1537-0.1091)\times612.1=27.3\ [\text{cm}^3/\text{s}]$$

$$Qe=0.1537\times1127=173.2\ [\text{cm}^3/\text{s}]$$

$$Qa=Qb+Qe=200.5\ [\text{cm}^3/\text{s}]$$

The following is a summary of the herein above described methods to calculate the volume of argon injected into the steel and volume of argon escaping in a system using an argon injected slide gate to control the flow of liquid steel through a nozzle. The argon injected slide gate having an argon injection point.

Steel Pressure Change Event Method

Herein after this method will be known as the "Steel Pressure Change Event Method".

The method includes the initial step of creating a steel pressure change event by changing the steel pressure above the slide gate with respect to time. The method also includes the steps of measuring the argon pressure (Pa) vs time and calculating the steel pressure (Ps) vs time during the steel pressure change event, wherein the steel pressure is calculated by multiplying the height of the steel above the argon injection point multiplied by the density of the steel times the acceleration due to gravity. The method further includes the step of measuring the average argon flow rate (Qa') during the steel pressure change event. The method also includes the step of plotting the steel pressure on the x-axis of a graph versus argon pressure on the y-axis during the steel pressure change event (Pa–Ps plot). Once the graph is plotted the method calls for fitting a line to the Pa–Ps plot. The line has the general formula y=Mx+B, wherein M is the slope of the line and B is the y-intercept of the line and then measuring the slope M and y-intercept B of the line.

Next, the method calls for calculating the argon injection bubbling conductance Gb using the formula: Gb=(M/B)×Qa'. The method also calls for measuring the argon pressure (Pa') and calculating the steel pressure (Ps') immediately after the steel pressure change event. Then the steel injection argon flow rate Qb is calculated using the formula: Qb=(Pa'–Ps')×Gb and the argon escaping conductance Ge is calculated using the formula: Ge=(Gb/M)–Gb. Finally, the argon escape flow rate Qe using the formula: Qe=Pa'×Ge.

Argon Flow Rate Change Method

Herein after this method will be known as the "Argon Flow Rate Change Event Method".

The method includes the initial step of creating an argon flow change event by changing the argon flow rate into the slide gate with respect to time. The method also includes the step of measuring the argon pressure (Pa) vs time and measuring the argon flow rate (Qa) vs time during the argon flow change event. Also, the method includes calculating the average steel pressure (Ps) during the argon flow change event. Also, the steel pressure (Ps') is calculated at the end of the argon flow change event.

The method also includes the step of plotting the argon flow on the x-axis of a graph versus argon pressure on the y-axis during the argon flow change event (Pa–Qa plot) and fitting a line to the Pa-Qa plot. The line has the general formula y=Mx+B, wherein M is the slope of the line and B is the y-intercept of the line. The next step is to measure the slope M and y-intercept B of the line.

Next the argon injection bubbling conductance Gb is calculated using the formula: Gb=B/(M*Ps'). The next step is measuring the argon pressure (Pa') and calculating the steel pressure (Ps') immediately after the argon flow change event.

Next the argon injection flow rate Qb is calculated using the formula: Qb=(Pa'–Ps')*Gb. The argon escaping conductance Ge is calculated using the formula: Ge=(1/M)–Gb; and the argon escape flow rate Qe is calculated using the formula:

$$Qe=Pa'*Ge.$$

Steel Cleanliness

Steel cleanliness is determined by the number, size, shape, and composition of the final nonmetallic inclusions in the steel matrix. Most inclusions in steel castings are a product of deoxidation in the ladle or reoxidation during processing. During deoxidation, the dissolved oxygen content of the steel is reduced by adding elements that have a greater affinity for oxygen than carbon and form thermodynamically more stable oxides than iron oxide. The most common deoxidizer for steel castings is aluminum, which produces solid particles of $Al_2O_3$. Alumina inclusions are dendritic when formed in a high oxygen environment such as reoxidation and often coalesce to create irregular shaped "alumina clusters" as a result of the collision of smaller particles. Also, alumina is not wet-able by steel, so surface tension causes the cluster to be a lower energy state (less surface area). These clusters significantly affect the mechanical properties of steel.

A number of studies indicate that argon purging in the tundish might have benefits on steel cleanliness. One principle behind these technologies is that the steel in the tundish will pass through a curtain of argon bubbles that will capture the solid inclusions and float them into the tundish slag.

Also, during casting the exposure of liquid steel to air is a gross source of oxygen and nitrogen and such events can typically be measured by nitrogen pickup in the steel. One option to control oxidation uses an argon purge around the metal transfer points (ladle to tundish and tundish to mold) in order to minimize air ingress.

Studies have shown that injecting an argon gas purge through upper plate of the sliding gate lowered the amount of 50-100 μm sized inclusions from 3 to 0.6 per $cm^2$, and lowered 100-200 μm macro-inclusions from 1.4 to 0.4 per $cm^2$.

However, if too much argon is injected into the steel, emulsification of the slag may occur, where slag and steel intermix and even create a foam. This allows easy capture of particles via vortexing or surface shearing flow. Therefore, there is maximum limit of the argon gas injection flow rate into the steel beyond which steel cleanliness is reduced.

Also, argon injection rate must be a level which maintains a stable double-roll flow pattern in the caster. The argon injection rate should be kept safely below a critical level because excessive argon injection may generate transient variation of the jets entering the mold, introduce asymmetry in the mold cavity, and increase surface turbulence. Further, argon gas bubbles may become entrained and trapped in the solidifying steel to form blister defects, such as pencil pipe in the final product. This in turn reduces steel cleanliness.

However, argon gas bubbles also capture inclusions as they flow into the steel casting mold. A tremendous number of alumina particles can be captured by a single bubble especially a large bubble owing to its larger surface area. This phenomenon is good for inclusion removal if the bubbles float out. However, inclusion-coated bubbles are very bad for steel cleanliness if they are entrapped by the solidifying steel. Entrapped solid oxide particles eventually lead to surface slivers or internal defects and a reduction in steel cleanliness.

Figure 10:
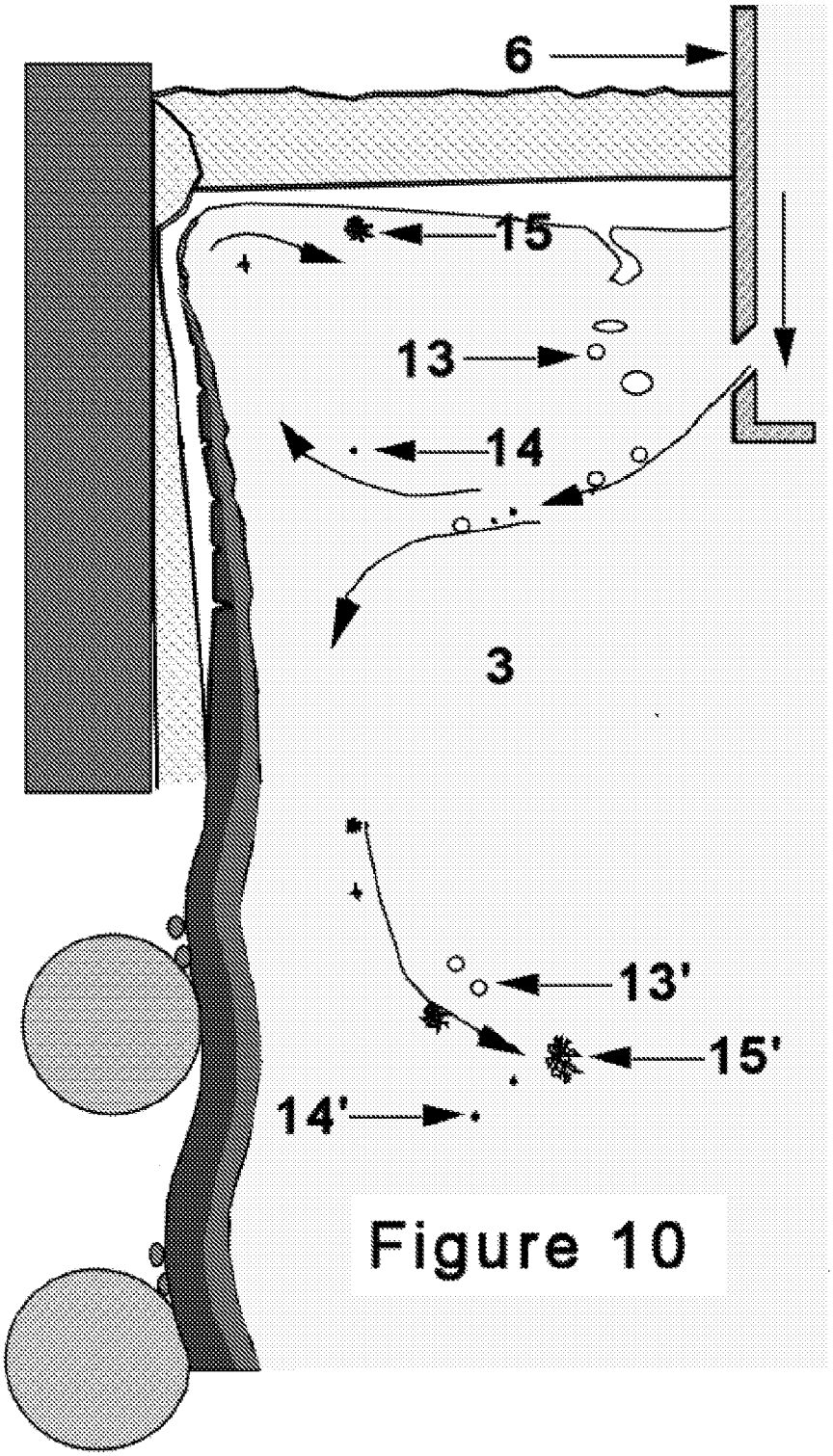
FIG. 10 is a schematic of the steel caster 3 showing argon bubbles and particulate inclusions.

FIG. 10 is a schematic of the steel caster 3. In the steel there is depicted the various inclusions: argon bubbles 13, micro particles 14, and agglomerated particles 15. If the inclusions are not removed in the top slag or the argon bubbles do not rise up out of the steel, they will become embedded into the cast steel as entrained argon bubbles 13'; micro inclusions 14'; and macro inclusions 15'.

Thus, there is an optimal argon injection rate which will result in production of steel slab having both a low inclusion rate along with low bubble argon entrapment.

The present method involves selecting a steel composition to be cast and then comparing the cleanliness of the steel slabs made at varying argon injection flow rates. The argon injection flow rate is calculated using either the Steel Pressure Change Event Method or the Argon Flow Rate Change Event Method.

Any method for determining steel cleanliness may be used as long as it is objectively quantifiable. Particularly useful is the optimal reduction in the quantity of micro and macro inclusions trapped in the cast steel. Also, useful is the optimal reduction in entrained argon bubbles trapped in the cast steel. For example, steel cleanliness may be determined by using any one or more of the following published methods:

ASTM E2142 Standard Test Methods for Rating and Classifying Inclusions in Steel Using the Scanning Electron Microscope;

ASTM E2283 Standard Practice for Extreme Value Analysis of Nonmetallic Inclusions in Steel and Other Microstructural Features;

SIS 111116 Jernkontoret's Inclusion Chart Ii for Quantitative Assessment of the Content of Non-metallic Inclusions in Metals and Alloys;

DIN 50602 Metallographic Test Methods; Microscopic Examination of Special Steels Using Standard Diagrams to Assess the Content of Non-metallic Inclusions;

ISO 4967 Steel-Determination of Content of Non-metallic Inclusions-Micrographic Method Using Standard Diagrams;

EN 10247 Micrographic Examination of the Non-metallic Inclusion Content of Steels Using Standard Pictures;

JIS G0555 Microscopic Testing Method for the Non-Metallic Inclusions in Steel;

NFA 04-106 Iron and Steel-Methods of Determination of Content of non Metallic Inclusions in Wrought Steel-Part 2: Micrographic Method Using Standards Diagrams; and GBT 30834 Standard Test Methods for Rating and Classifying Inclusions in Steel. Scanning Electron Microscope.

The present method uses an argon injected slide gate controlling the flow of liquid steel through a nozzle. The argon injection flow rate at a specific point in time is calculated using the above described methods. This flow rate is recorded and then the injection flow rate at this specific point in time is compared with the steel cleanliness of the cast slab for that same time in the cast. The injection flow rate of argon is then varied and a new argon injection flow rate at another specific point in time is calculated and recorded. This new argon injection flow rate is also compared with the steel cleanliness of the cast slab for that new cast time.

This varying/calculating/recording of injection flow rate of argon into the steel and comparing with the steel cleanliness of the cast slab for that flow rate continues through a range of argon flow rates. Then a plot of flow rate vs steel cleanliness can be made and an optimum flow rate for this particular steel can be established.

The argon injection flow rate is changed by calculating the injection conductance Gb and adjusting the total argon flow rate to arrive at the desired flow rate. That is, Gb is calculated using either the Steel Pressure Change Event Method or the Argon Flow Rate Change Event Method. Once Gb is known Qb, the argon injection flow rate can be determined by multiplying Gb with the difference between the present argon pressure and the present steel pressure (Pa'−Ps'), i.e. Gb(Pa'−Ps'). Thus, to vary Qb, when Gb is constant, Pa' may be varied. Also, Qa may be varied directly, which indirectly varies Pa'.

Summary of Method for Determining Optimal Argon Injection into Steel

The method includes the step of providing an argon injected slide gate controlling the flow of liquid steel through a nozzle. A desired alloy for casting into slabs is chosen. The method also includes determining the injection flow rate conductance Gb of the argon injected slide gate using either the Steel Pressure Change Event Method or the Argon Flow Rate Change Event Method. Next a desired argon injection flow rate Qb is selected and recorded. The present steel pressure Ps' is calculated by multiplying the present height of the steel above the argon injection point by the density of the selected steel composition times the acceleration due to gravity. Next the required present argon pressure Pa' to provide the desired argon injection Qb is calculated using the equation Pa'=Qb/Gb+Ps'. Next the selected steel composition is cast while injecting argon into the steel at the desired argon injection flow rate. Then the cast steel is analyzed to evaluate its cleanliness.

The argon injection flow rate is varied and the cast steel, at these varied argon injection flow rates, is analyzed to evaluate its cleanliness. This is repeated a plurality of times to create a data set of Qb versus steel cleanliness data. A plot of the data set is graphed and analyzed to determine the optimal argon injection flow rate Qb* to optimize steel cleanliness for the desired alloy.

Maintaining Optimal Argon Injection Flow Rate into Cast Steel

Once the optimal argon injection flow rate Qb* is determined for a chosen steel, it is then desirable to maintain that flow rate throughout the entire casting campaign for that alloy. However, because the slide gate is not stable over time (i.e. the amount of gas escaping versus injected into the steel changes with time), the amount of argon injected into the steel will change with time.

Therefore, during the casting campaign, the initial flow rate conductance Gb is calculated by the Steel Pressure Change Event Method or the Argon Flow Rate Change Event Method. Then, as the amount of gas escaping versus injected into the steel changes with time, the present injection flow rate conductance Gb' of the slide gate must be determined often by using either the Steel Pressure Change Event Method or the Argon Flow Rate Change Event Method. It should be noted that the present flow rate conductance Gb' is the Gb recited in the methods above and the prime (') symbol indicates that it is a transient number that will change. Further, the present steel pressure Ps' must be calculated by multiplying the present height of the steel above the argon injection point multiplied by the density of said selected steel composition times the acceleration due to gravity.

Now, with the known quantities Gb', Qb*, and Ps', the presently required total argon pressure Pa' to achieve the optimal argon injection flow rate Qb* can be calculated by the equation:

$$Pa'=Qb^*/Gb'+Ps'.$$

Periodically, as the slide gate deteriorates, the present injection flow rate conductance Gb' of the slide gate must be redetermined by using either the Steel Pressure Change Event Method or the Argon Flow Rate Change Event Method. Also, as Ps' changes, Pa' will directly proportionately change as well. Thus, Ps' must also be redetermined on a regular basis. The values of Gb' and Ps' may be regularly determined concurrently with each other or they may be determined non-concurrently. The time interval between determination of Gb' and Ps' may be the same or different.

The time intervals between determination of Gb' and Ps' may be variable. Whenever a new value of Gb' or Ps' is determined, a new Pa' is calculated and the argon pressure is adjusted accordingly.

We claim:

1. A method for maintaining an optimal argon injection flow rate for a chosen alloy composition during casting to produce optimal steel cleanliness in a cast steel, the method comprising:

a) providing an argon injected slide gate controlling the flow of liquid steel through a nozzle;

b) selecting a steel having a steel composition to be cast, the selected steel having a known optimal argon injection flow rate Qb* for the selected steel;

c) determining a present injection flow rate conductance Gb' of the argon injected slide gate using either a formula: Gb'=(M/B)×Qa', wherein Qa' is an average argon flow rate during a steel pressure change event, M is a slope of a line on a graph having an x-axis and a y-axis, the graph plotting a steel pressure and an argon pressure during the steel pressure change event, the steel pressure plotted on the x-axis of the graph and the argon pressure plotted on the y-axis of the graph, and B is the y-intercept of the line, or a formula: Gb'=B/(M*Ps), wherein Ps is a steel pressure immediately after an argon flow change event, B is a y-intercept of a line on a graph having an x-axis and a y-axis, the graph plotting an argon flow and an argon pressure during the argon flow change event, the argon flow plotted on the x-axis and the argon pressure plotted on the y-axis, and M is a slope of the line;

d) calculating a present steel pressure Ps', wherein the present steel pressure is calculated by multiplying a present height of the steel above the argon injection point multiplied by the density of the steel composition times the acceleration due to gravity;

e) calculating a required present argon pressure Pa' to provide the optimal argon injection flow rate Qb*, using the equation Pa'=Qb*/Gb'+Ps';

f) adjusting a present argon pressure to the calculated required present argon pressure Pa';

g) casting the selected steel with the steel composition while injecting argon into the selected steel at the optimal argon injection flow rate Qb*;

h) repeating at least one of the steps c) to g) a plurality of times until all of the selected steel has been cast.

2. The method as recited in claim 1 wherein the step of determining the present injection flow rate conductance Gb' of the argon injected slide gate uses the formula: Gb'=(M/B)×Qa'.

3. The method as recited in claim 1 wherein the step of determining the present injection flow rate conductance Gb' of said argon injected slide gate uses the formula: Gb'=B/(M*Ps').

4. The method as recited in claim 1 wherein steps c) and d) are always performed concurrently.

5. The method as recited in claim 1 wherein steps c) and d) are performed non-concurrently.

* * * * *